US005953553A

United States Patent [19]

Eto et al.

[11] Patent Number: 5,953,553

[45] Date of Patent: Sep. 14, 1999

[54] AUTOMATIC DOCUMENT FEEDER

[75] Inventors: Kouichi Eto; Naoyuki Kamei, both of Nara, Japan

[73] Assignee: Sharp Kabushiki Kaisha, Osaka, Japan

[21] Appl. No.: 08/966,704

[22] Filed: Nov. 10, 1997

[30] Foreign Application Priority Data

Nov. 11, 1996 [JP] Japan ..... 8-298883

[51] Int. Cl.[6] ..... G03G 15/00

[52] U.S. Cl. ..... 399/17; 399/367

[58] Field of Search ..... 399/16, 17, 18, 399/21, 367

[56] References Cited

U.S. PATENT DOCUMENTS

| | | | |
|---|---|---|---|
| 4,332,462 | 6/1982 | Yagasaki et al. | 399/17 |
| 4,372,673 | 2/1983 | Tomosada et al. | 399/17 |
| 4,907,031 | 3/1990 | Kawatsura et al. | 399/19 |
| 5,008,714 | 4/1991 | Higashio et al. | 399/367 |
| 5,105,229 | 4/1992 | Ozaki | 399/17 |
| 5,761,567 | 6/1998 | Yoshizuka | 399/17 |

FOREIGN PATENT DOCUMENTS

| | | |
|---|---|---|
| 61-111260 | 5/1986 | Japan . |
| 62-169568 | 7/1987 | Japan . |
| 4-30179 | 2/1992 | Japan . |

*Primary Examiner*—Sandra Brase

[57] ABSTRACT

When copying is automatically started using an automatic original document feeder, an automatic start operation is prohibited after an original document jam is eliminated. When copying operations are interrupted due to an original document jam during the copying operation, an automatic original document feeder is opened and a jammed original document is removed, and the automatic original document feeder is closed again and the original document jam is eliminated, in the case that there still is an original document remaining in the automatic original document feeder after the original document jam is eliminated. An automatic start prohibiting flag is turned on. Conversely, when there is no original document remaining in such a manner, the automatic start prohibiting flag is turned off. Thus, even when there is an original document remaining in the automatic original document feeder after the original document jam is eliminated, the automatic start operation upon detection of an original document is prohibited so that a time for setting the jammed original document which is removed once again is ensured.

8 Claims, 6 Drawing Sheets

AUTOMATIC DOCUMENT FEEDER

BACKGROUND OF THE INVENTION

1. Field of the Invention

The present invention relates to an image forming apparatus which is typically represented by electrophotographic copying machines, printers, facsimile machines, etc., and more particularly, to an improvement of control means of an automatic original document feeder which is disposed to such apparatuses.

2. Description of the Related Art

In the case of an electrophotographic copying machine, for example, such a copying machine is in a popular use which comprises an automatic original document feeder which is attached on an original document seater of the copying machine for the purpose of enhancing the copying efficiency of a number of copies of an original document. As a first example of a conventional technique regarding a copying machine with an automatic original document feeder, Japanese Unexamined Patent Publication JP-A 61-111260 (1986) discloses an automatic original document feeder which detects that an original document is set at an insertion part and automatically starts feeding the original document upon the detection and in accordance with an output signal which is supplied after a predetermined period of time under the control of a timer.

In addition, as a second example of the conventional technique, Japanese Unexamined Patent Publication JP-A 4-30179 (1992) discloses an image forming apparatus in which there are at least two or more original document seaters disposed in an automatic original document exchange means and after formation of an image of an original document which is fed from a first original document seater, for instance, is stopped and the absence of the original document on the first original document seater is detected, feeding of another original document is automatically started upon detection of setting of the another original document on the original document seaters.

Further, as a third example of the conventional technique, Japanese Unexamined Patent Publication JP-A 62-169568 (1987) discloses an automatic original document feeder (ADF) which optically detects a mislaid original document before reading an original document when there is the mislaid original document at a stationary original document reading position, stops a subsequent ADF operation, and displays an alarm message which is indicative of the mislaid original document.

By the way, in a copying machine such as the respective examples of the conventional technique which has an automatic start function, an original document sensor turns on and copying is started automatically upon setting of a plurality of original documents to an automatic original feeder. However, where an original document jam occurs as the original documents get jammed, when there still is an original document which is left set in the automatic original feeder after the original document jam is eliminated by removing the jammed original documents, automatic feeding of the original documents is started without waiting for the removed original document to be returned. Hence, an operator must set the unremoved original document to the automatic original feeder once again and copy the jammed original document after copying of all original documents on original document seaters is completed, which in turn changes the order of the original documents.

Further, although copying is suspended as an operator gives a copying suspend instruction for interruption, stopping or the like of copying, in the case that there is an original document which is left set in the automatic original feeder, automatic feeding of original documents is started soon, and the operator cannot suspend the copying despite the instruction.

Still further, when the automatic original feeder is open and an original document is set in the automatic original feeder, as soon as an operator closes the automatic original feeder to perform copying, the original document which is set on the automatic original feeder is automatically fed, thereby creating a situation which is not the operator's intention to perform copying of the other original document. In addition, even when copying of the original document which is set in the automatic original feeder is desired, an impact which is created when the automatic original feeder is closed disturbs the condition in which the original document is set, possibly creating a situation that the original document is fed as it is inclined obliquely at an angle.

SUMMARY OF THE INVENTION

An object of the invention is to provide an image forming apparatus which resumes copying original documents as they are oriented not in an angled direction but in a correct direction in accordance with a correct original document order after eliminating a jam when such copying is desired by an operator.

To achieve the object above, in a first aspect of the invention, an image forming apparatus comprises an automatic original document feeder; original document detection means for detecting that an original document is set in the automatic original document feeder; and automatic start control means for automatically starting an image formation operation upon receipt of an original document detection signal from the original document detection means, wherein the automatic start control means has a function of prohibiting an automatic start operation upon detection of a signal which demands suspension of an automatic start operation, from the image forming apparatus main body or the automatic original document feeder, even when the original document detection signal from the original document detection means is received.

In the invention, since the apparatus is provided with the function of prohibiting the automatic start operation upon receipt of the signal which demands suspension of the automatic start operation even when the signal indicating that an original document is set, it is possible to prohibit resumption of the automatic start operation in a situation where suspension of the automatic start operation signal is demanded, for example, during a conventional original document jam, when a copying suspend signal demanded by an operator is output or when the automatic original document feeder in an open state is closed.

A specific example of the signal which demands suspension of the automatic start operation is a signal which is output when an original document jam occurs on the automatic original document feeder. In this case, the automatic start control means prohibits the automatic start operation even upon receipt of the original document detection signal from the original document detection means after the original document jam is eliminated by removing the jammed original document, and therefore, it is possible to set the removed original document once again.

In a second aspect of the invention, in the case of an original document jam on the automatic original document feeder, after the original document jam is eliminated by removing the jammed original document, the automatic start operation is not resumed even when the original document detection signal from the original document detection means is received. Accordingly it is possible to ensure time for returning the removed original document to the automatic original document feeder. In addition, when it is necessary to reorganize the order of forming images of original documents, the jam does not disturb the order.

Further, another example of the signal which demands suspension of the automatic start operation is a copying suspend signal demanded by an operator. In this case, the automatic start control means prohibits the automatic start operation even upon receipt of the original document detection signal from the original document detection means after the copying suspend signal is output, and therefore, it is possible to avoid immediate resumption of the automatic start operation even when an original document remains in the automatic original document feeder, owing to the copying suspend instruction.

In a third aspect of the invention, when the copying suspend instruction is demanded by an operator, it is possible to avoid immediate resumption of the automatic start operation even though an original document is detected in the automatic original document feeder after the automatic start operation signal is output.

A further example of the signal which demands suspension of the automatic start operation is a signal which is output when the automatic original document feeder in an open state is closed. In this case, when this signal is output, the automatic start control means prohibits the automatic start operation even though the original document detection signal from the original document detection means is received, and therefore, even when, under a condition where another original document is set in the automatic original document feeder and the automatic original document feeder is left open, the automatic original document feeder is closed without knowing this condition, the start of the automatic start operation is immediately avoided.

In a fourth aspect of the invention, since the automatic start operation is not resumed even when it is detected that the automatic original document feeder in an open state is closed and an original document is detected, in a condition where another original document which an operator is not aware of is set in the automatic original document feeder and the automatic original document feeder is left open, when the operator closes the automatic original document feeder without knowing this condition, the automatic start operation is not started immediately. This prevents an unnecessary image formation operation. In addition, it is possible to prevent an original document from getting fed as it is inclined at an angle due to disturbance to the condition in which the original document is set because of an impact which is created when the automatic original document feeder is closed.

By the way, with the automatic start operation prohibited despite detection of an original document, it is not possible to resume copying. Moreover, with this condition left unchanged, another operator is prohibited from copying with the automatic original document feeder.

To deal with this, in the invention, the automatic start control means has a function of allowing resumption of copying when a print switch disposed in the main body of the copying machine is pressed or detecting a change in the condition of the original document detection means and starting copying in the condition where the automatic start operation is prohibited despite detection of an original document. Hence, as an original document is set in the automatic original document feeder, the image formation operation using the automatic original document feeder is resumed from the condition where the automatic start operation is prohibited.

In a fifth aspect of the invention, in an apparatus in which image formation is automatically started upon setting of an original document in an automatic original document feeder, it is possible to resume a copying operation using the automatic original document feeder, from a condition where the automatic start operation is prohibited.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
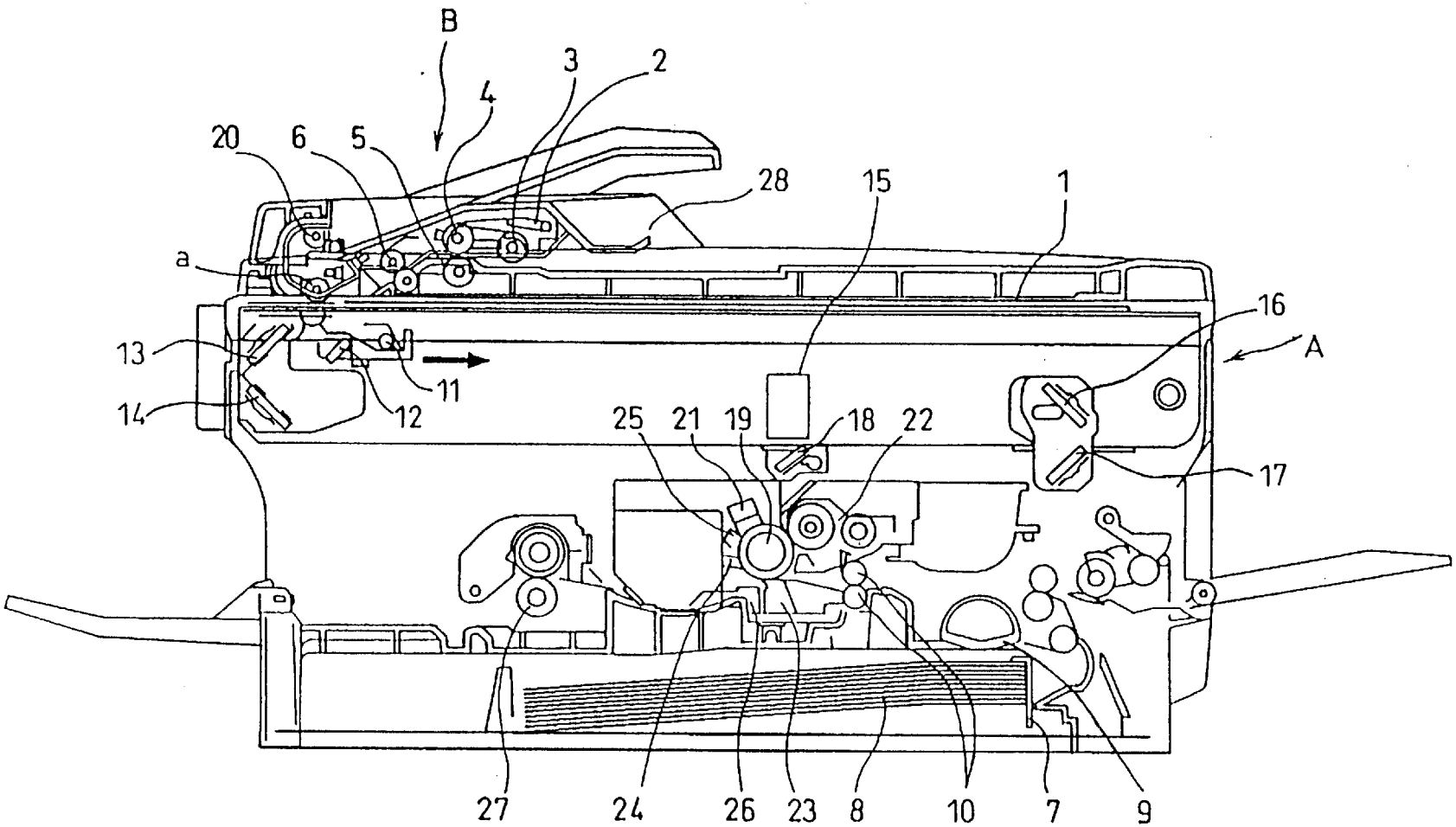
FIG. 1 is a cross sectional view of an electrophotographic copying machine according to a first preferred embodiment of the invention.

Now referring to the drawings, preferred embodiments of the invention are described below.

Figure 2:
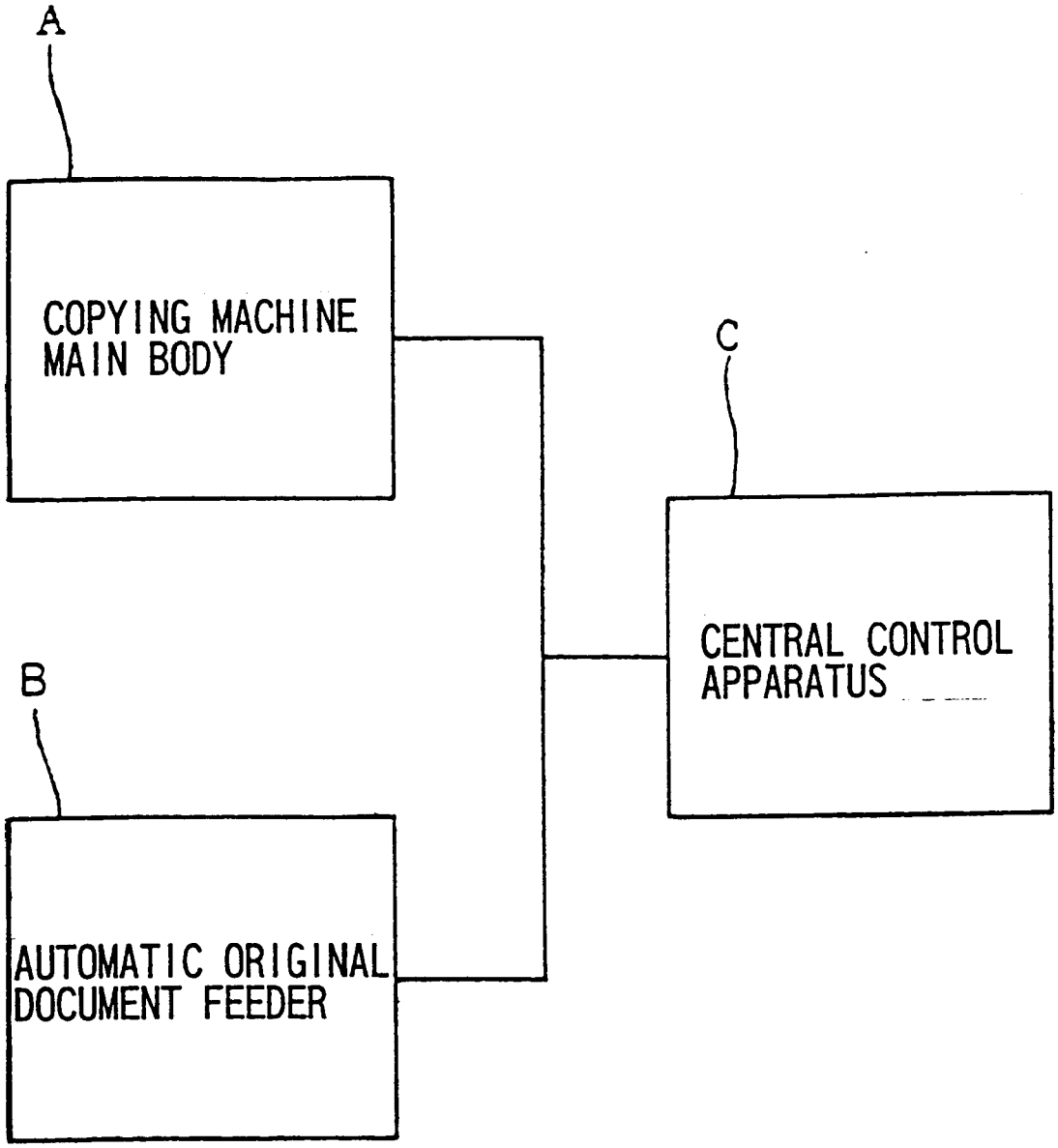
FIG. 2 is a block diagram of a control system of the electrophotographic copying machine.

While referring to the drawings, a preferred embodiment for applying the invention to an electrophotographic copying machine will be described below in detail. FIG. 1 shows a structure of the machine in cross section, while FIG. 2 shows a control system. As shown in FIG. 2, the copying machine of the preferred embodiment comprises a copying machine main body A, an automatic original document feeder B, and a central control apparatus C which is formed by a microcomputer which controls the entire copying machine main body A and the entire automatic original document feeder B.

As shown in FIG. 1, the automatic original document feeder B is disposed on an original document seater 1 which is formed on a top surface of the copying machine main body A in such a manner that the automatic original document feeder B is freely opened and closed and sets a number of original documents one by one on a transparent hard glass of the original document seater 1. Alternatively, instead of using the automatic original document feeder B, original documents may be set on the original document seater 1 of the copying machine main body A manually after opening the automatic original document feeder B.

Now, copying using the automatic original document feeder B will be described. As original documents are set in the automatic original document feeder B and detected by an original document detection sensor 2 which is formed by an actuator, the copying machine main body A starts copying. Upon start of copying, only one of the plurality of original documents (not shown) which are set in the automatic original document feeder B is fed by an original document inserting roller 3, an original document transporting roller 4 and an original document separating roller 5 which are disposed within the automatic original document feeder B and then resisted and stopped by an original document resist roller 6 which is disposed within the automatic original document feeder B.

At the same time, in the copying machine main body A, a copy paper 8 which is loaded in a cassette 7 is conveyed to a resist roller 10 which is formed by a pair of rollers from a sheet inserting roller 9 while corrected so that the copy paper is not inclined obliquely at an angle. Following this, the original document resist roller 6 of the automatic original document feeder B rotates in synchronization to rotation of the resist roller 10 of the copying machine main body A, whereby the original document is transported to a reading position a on the original document seater 1. Concurrently with this, an irradiation lamp 11 which is disposed within an irradiation lamp unit of the copying machine main body A is turned on so that lamp light is irradiated upon the original document which is placed on the original document seater 1.

Reflected light from the irradiation lamp 11 is irradiated upon a photosensitive drum 19 which is attached for free rotation, through a first mirror 12 which is disposed within the irradiation lamp unit and a second mirror 13, a third mirror 14, a lens 15, a fourth mirror 16, a fifth mirror 17 and a sixth mirror 18 which are disposed within an optical unit. Prior to irradiation of the reflected light, a surface photosensitive layer of the photosensitive drum 19 is uniformly charged through a corona discharge treatment which is performed by a charger 21 of the copying machine main body A.

As the original document moves passed the reading position a while at the same time the photosensitive drum 19 rotates in the clockwise direction, an image of the original document exposes the surface photosensitive layer of the photosensitive drum 19, whereby an electrostatic latent image of the original document is formed on the photosensitive drum 19. When irradiation of the original document is completed in this manner, the irradiation lamp 11 is turned off, and the original document is discharged as it is by an original document discharging roller 20 of the automatic original document feeder B.

The electrostatic latent image is developed by a toner which is supplied to the surface photosensitive layer of the photosensitive drum 19 from a developer unit 22, and a resulting toner image is transferred onto the copy paper 8 by a transfer unit 23. At this stage, a developer agent which remains on the photosensitive drum 19 is cleaned by a cleaner 24 and electric charges on the photosensitive drum 19 are removed by means of antistatic light from an antistatic unit 25, in preparation for the next copying. On the other hand, the copy paper 8 with the image of the original document transferred by the transfer unit 23 is separated from the photosensitive drum 19 as a result of discharging from a separation electrode 26 and transported to a fixing unit 27, so that the toner image on the copy paper 8 is fixed by the fixing unit 27 and the copy paper 8 is discharged outside the copying machine main body A.

The electrophotographic copying machine of the preferred embodiment which has such a structure and performs such an operation described above is equipped with an automatic start function for automatically starting copying when the original document detection sensor 2 is turned on as a plurality of original documents are set in an original document tray 28 of the automatic original document feeder B. The preferred embodiment, therefore, enables to control such that after a jammed original document is removed in the condition of an original document jam due to the jammed original document, a time for inserting the jammed original document to an original position is created in the following manner.

Figure 3:
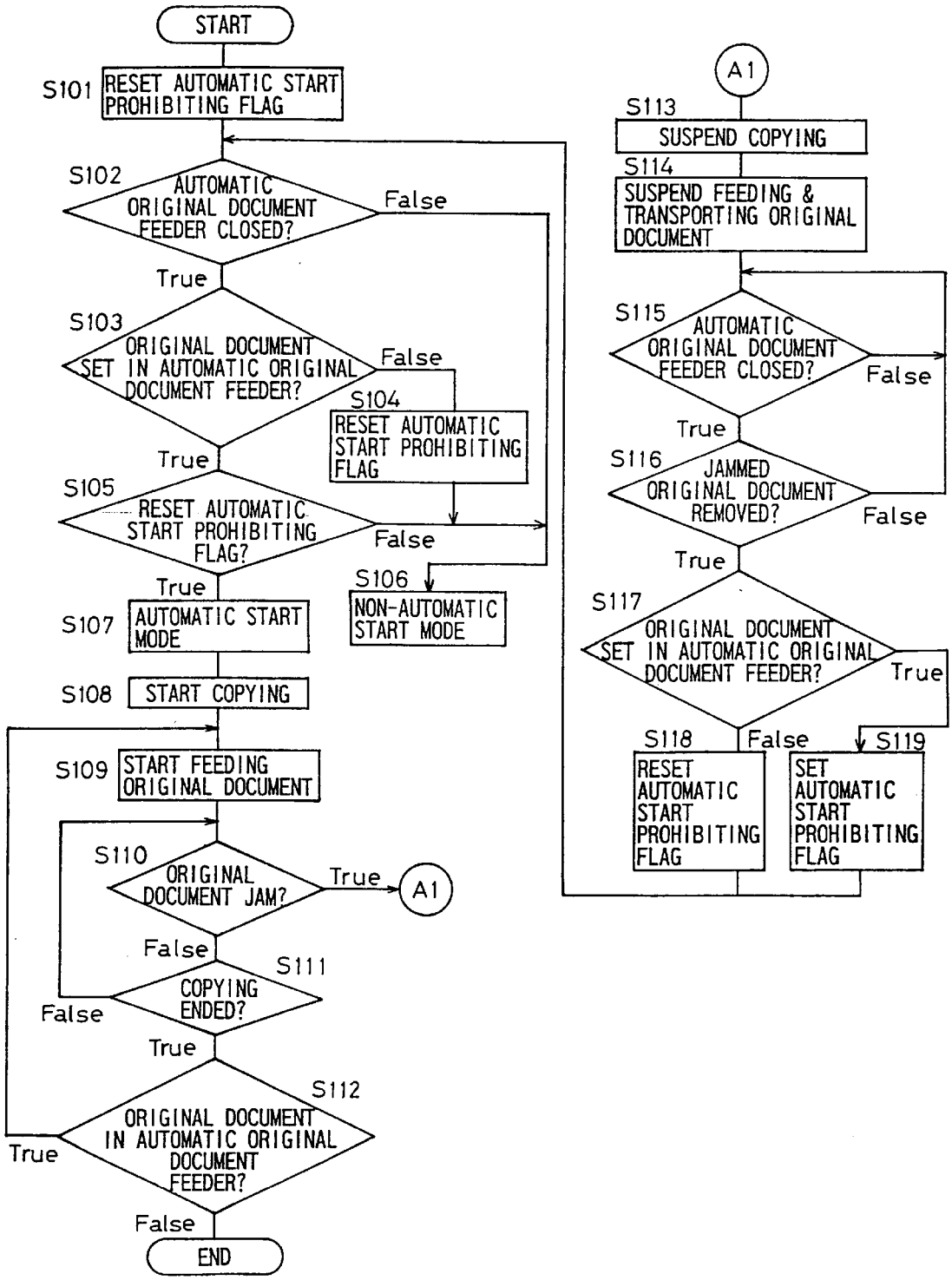
FIG. 3 is a flowchart showing an operation during an automatic start function performed by a central control apparatus.

FIG. 3 shows a flow in which the central control apparatus C controls when executing the automatic start function. As shown in FIG. 3, as a power source is turned on, an automatic start prohibiting flag is reset (step S101). With the automatic original document feeder B closed (step S102), when original documents are set in the automatic original document feeder B (step S103), in the case that the automatic start prohibiting flag is OFF (step S105), an automatic start mode for automatically feeding original documents is invoked (step S107) and the copying operations described earlier is automatically started (step S108).

That is, after feeding of the original documents is started (step S109), when copying of one original document is completed (step S111) without detecting an original document jam (step S110), the copying operations from the step S109 through the step S112 are repeated until the original documents set on the original document tray 28 of the automatic original document feeder B run out. When the original documents set on the original document tray 28 have run out, all copying operations are ended. When the automatic original document feeder B is open at step S102, a non-automatic start mode is invoked (step S106).

Where an original document jam occurs between the copying operations described above at step S110, the copying operations are stopped (step S113) and transportation of the original documents is suspended (step S114). An operator opens the automatic original document feeder B, removes an original document which caused the JAM, and closes the automatic original document feeder B again (step S115), whereby the original document JAM is eliminated (step S116). At this stage, when there still is an original document remaining in the automatic original document feeder B after the original document jam is eliminated (step S117), the automatic start prohibiting flag is turned on (step S119). Conversely, when there is no original document remaining in such a manner, the automatic start prohibiting flag is turned off (step S118). In the control process described above, even when there is an original document remaining in the automatic original document feeder B after the original document jam is eliminated, by means of the automatic start prohibiting flag, the control for prohibiting the automatic start operation upon detection of an original document is executed. Thus, copying is not automatically started, and therefore, it is possible to set the removed jammed original document once again. Since this creates a time for returning the removed original document to the automatic original document feeder, it is possible to continue copying without disturbing the order of copying the original documents.

Figure 4:
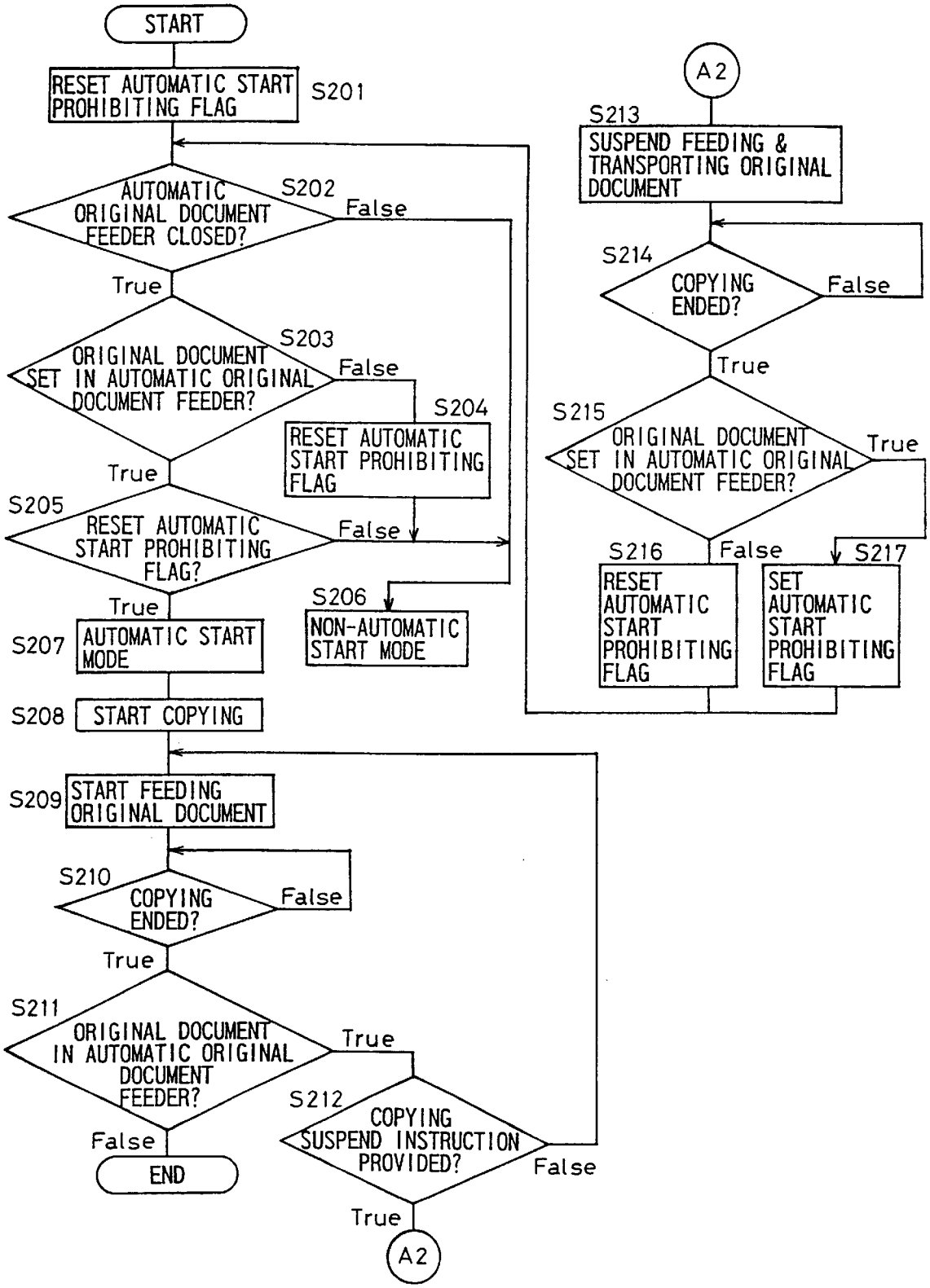
FIG. 4 is a flowchart showing an operation during an automatic start function performed by a central control apparatus of an electrophotographic copying machine according to a second preferred embodiment of the invention.

FIG. 4 shows a flow in which the central control apparatus C controls when executing the automatic start function in a second preferred embodiment of the invention. As in the precedent embodiment, an electrophotographic copying machine of the second prefer red embodiment is equipped with the automatic start function for automatically starting copying when a plurality of original documents are set in the automatic original document feeder, but also executes such a control which eliminates an inconvenience which occurs when an operator supplies a copying suspend instruction for interruption, stopping or the like of copying.

More precisely, as shown in FIG. 4, as t he power source is turned on, the automatic start prohibiting flag is reset (step S201). With the automatic original document feeder B closed (step S202), when original documents are set in the automatic original document feeder B (step S203), in the case that the automatic start prohibiting flag is OFF (step S205), the automatic start mode for automatically feeding original documents is invoked (step S207) and the copying operations which are similar to those of the precedent embodiment are automatically started (step S208).

After feeding of the original documents is started (step S209), when copying of one original document is completed (step S210), the copying operations are repeated until it is detected that no original document is left any more on the original document tray 28 of the automatic original document feeder B (step S211). The copying operations are ended when the original documents set on the original document tray 28 have run out. When the automatic original document feeder B is open at step S202, the apparatus is shifted to the non-automatic start mode(step S206).

During such copying operations, when an operator supplies the copying suspend instruction by turning on an interruption key, a copying cancel key or the like (step S212), the copying operations and transportation of the original documents is suspended (step S213). After copying of the original documents which used to be suspended is completed at step S214, when there still is an original document remaining in the automatic original document feeder B (step S215), the automatic start prohibiting flag is turned on (step S217). Conversely, when there is no original document remaining in such a manner, the automatic start prohibiting flag is turned off (step S216).

By means of the automatic start prohibiting flag, an immediate automatic start is avoided even when there is an original document remaining on the document tray 28 of the automatic original document feeder B after the copying operations are suspended in response to the copying suspend instruction given from an operator. Hence, it is possible to prevent unnecessary copying.

Figure 5:
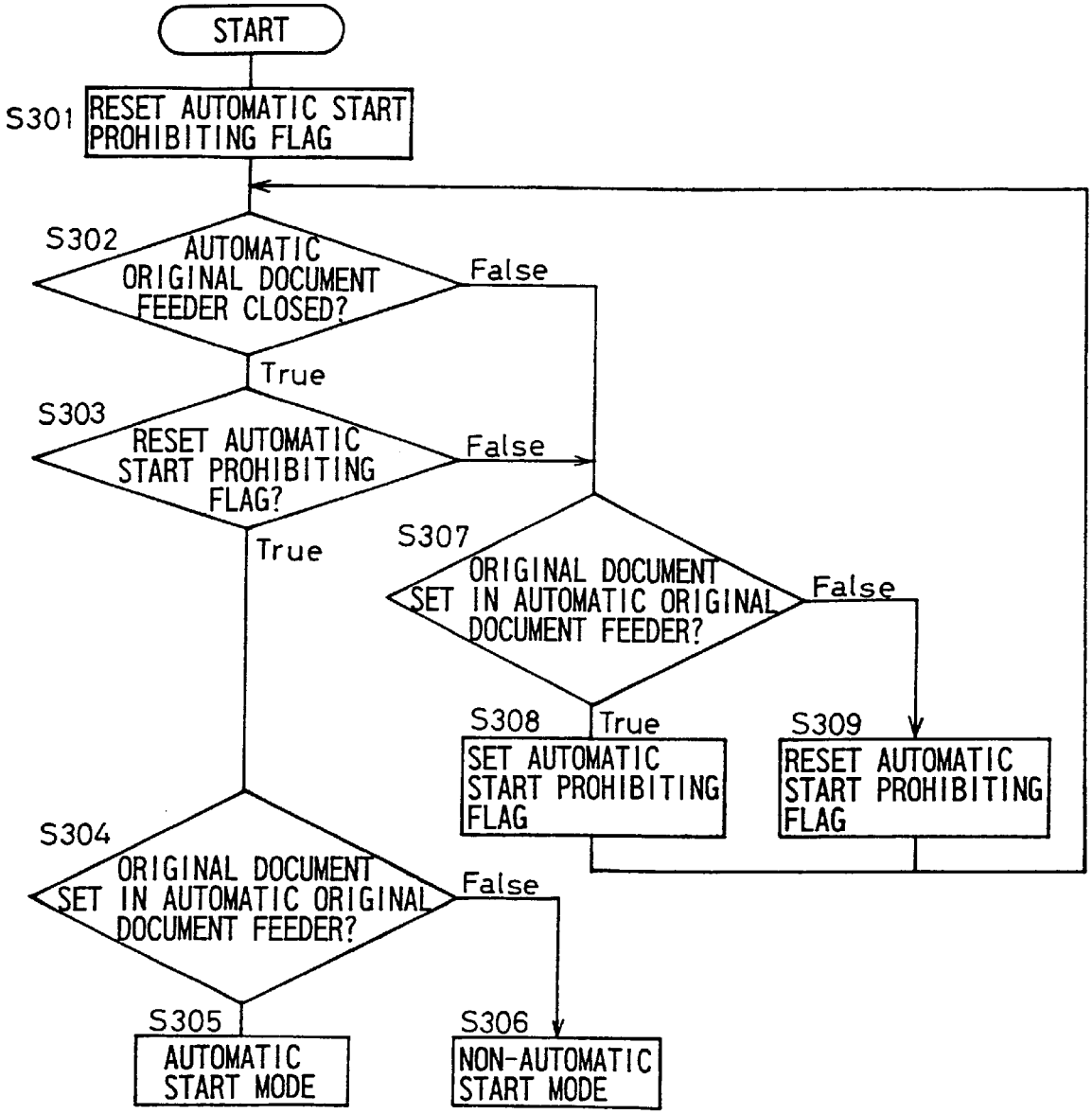
FIG. 5 is a flowchart showing an operation during an automatic start function performed by a central control apparatus of an electrophotographic copying machine according to a third preferred embodiment of the invention.

FIG. 5 shows a flow in which the central control apparatus C controls when executing the automatic start function in a third preferred embodiment of the invention. As in the respective precedent embodiments, an electrophotographic copying machine of the third preferred embodiment is equipped with the automatic start function for automatically starting copying when a plurality of original documents are set in the automatic original document feeder, but also executes such a control which eliminates an inconvenience that a situation an operator did not expect occurs as feeding of the original documents in the automatic original document feeder is automatically started as soon as an operator closes the automatic original document feeder with an intention to execute copying of other original document.

More precisely, as shown in FIG. 5, as the power source is turned on, the automatic start prohibiting flag is reset (step S301). With the automatic original document feeder B opened at step S302, when original documents are set in the automatic original document feeder B (step S307), the automatic start prohibiting flag is turned on (step S308). Conversely, when there is no original document set, the automatic start prohibiting flag is turned off (step S309).

Now, returning to the step S302, as the automatic original document feeder B is closed, the automatic start prohibiting flag is checked at step S303. In the case that the automatic start prohibiting flag is ON, the sequence waits until the automatic start prohibiting flag becomes OFF. When the automatic start prohibiting flag becomes OFF, whether there is an original document in the automatic original document feeder B is checked at step S304. In the case that there is an original document set, the automatic start mode is invoked at step S305. With no original document set, the non-automatic start mode is invoked at step S306.

Thus, as the automatic original document feeder B which used to be open is closed, when an original document is detected in the automatic original document feeder B, the control for prohibiting the automatic start operation upon detection of the original document is executed. Hence, even when, under a condition that an original document which an operator is not aware of is set in the automatic original document feeder B and the automatic original document feeder B is left open, the automatic original document feeder B is closed, the start of the automatic start copying is immediately avoided.

Figure 6:
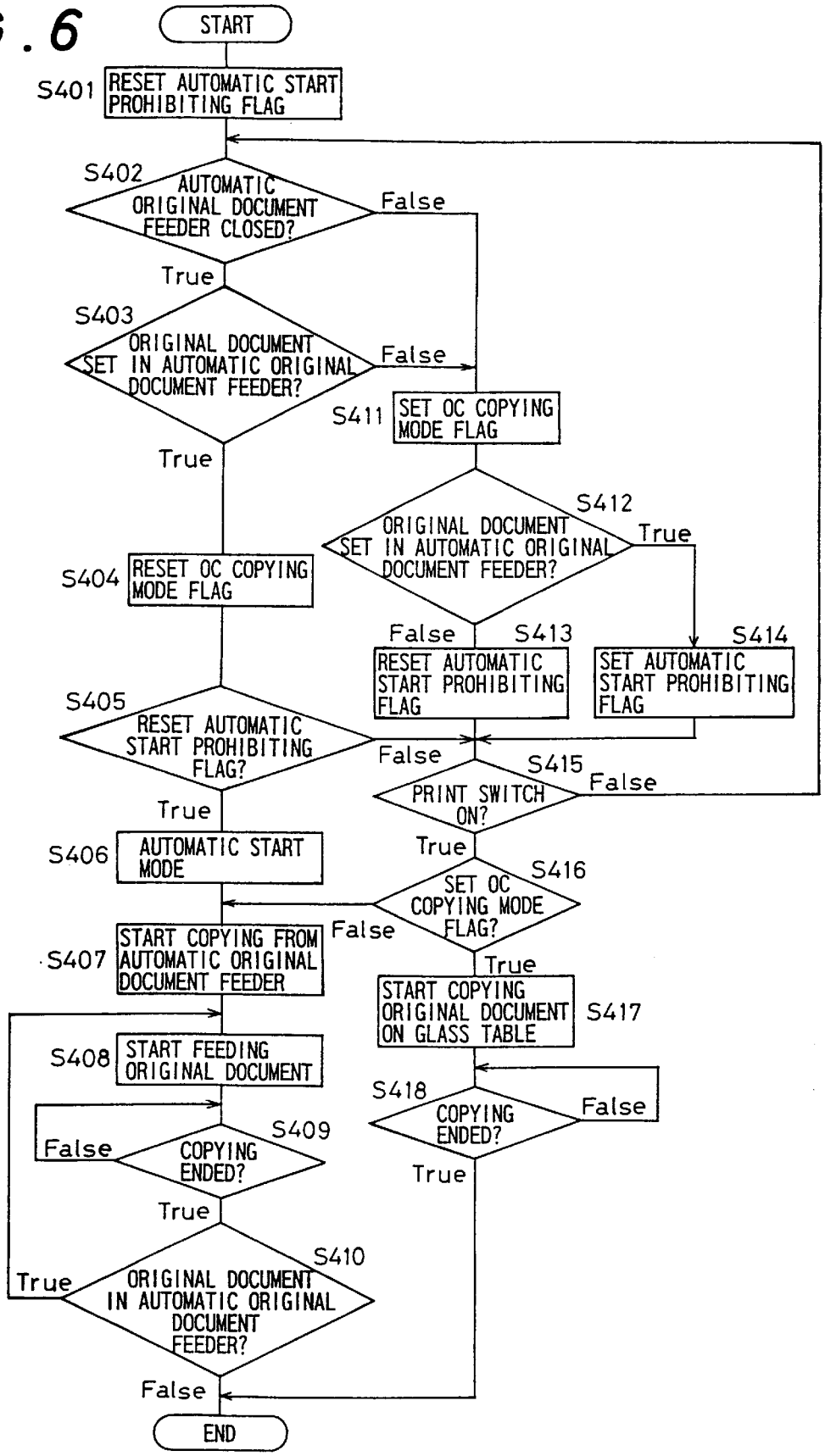
FIG. 6 is a flowchart showing an operation during an automatic start function performed by a central control apparatus of an electrophotographic copying machine according to a fourth preferred embodiment of the invention.

FIG. 6 shows a flow in which the central control apparatus C controls when executing the automatic start function in a fourth preferred embodiment of the invention. As in the respective precedent embodiments, an electrophotographic copying machine of the fourth preferred embodiment is equipped with the automatic start function for automatically starting copying when a plurality of original documents are set in the automatic original document feeder, but also executes such a control which eliminates an inconvenience which is created after the automatic start operation upon detection of an original document is prohibited as in the first to the third precedent embodiments.

More precisely, as shown in FIG. 6, as the power source is turned on, the automatic start prohibiting flag is reset (step S401). With the automatic original document feeder B closed at step S402, when original documents are set in the automatic original document feeder B (step S403), an OC copying mode flag is reset (step S404), and further, the automatic start prohibiting flag is checked (step S405). An OC copying mode is a method of setting original documents in which the entire automatic original document feeder B is lifted upward and an operator sets original documents one by one on the original document seater 1.

At this stage, in the case that the automatic start prohibiting flag is OFF, the automatic start mode is invoked (step S406), and the copying operations which are similar to those of the first embodiment are automatically started (step S407). After feeding of the original documents is started (step S408), when copying of one original document is completed (step S409), the copying operations from the step S408 through the step S410 are repeated until original documents set in the automatic original document feeder B run out. When the original documents set in the automatic original document feeder B have run out, all copying operations are ended.

Conversely, when the automatic start prohibiting flag is checked at step S405, in the case that the automatic start prohibiting flag is ON, whether a print switch (not shown) on the copying machine main body A is pressed is checked at step S415. With the print switch ON, the OC copying mode flag is checked at step S416. With the OC copying mode flag OFF, the copying operations which are similar to those of the first embodiment are automatically started (step S407). Conversely, with the OC copying mode flag ON, copying for scanning an original document on the original document seater 1 is started (step S417) and this is continued until the copying is completed (step S418).

In addition, when it is found that the print switch is OFF after whether the print switch is pressed is checked at step S415, whether the automatic original document feeder B is open is checked (step S402). At this stage, when the automatic original document feeder B is open, or even when the automatic original document feeder B is closed, unless there is an original document set in the automatic original document feeder B, the OC copying mode flag is set (step S411).

Following this, when it is found at step S412 that an original document is set in the auto document feeder B, the automatic start prohibiting flag is set (step S414), and when no original document is set in the automatic original document feeder B, the automatic start prohibiting flag is reset (step S413) and the sequence proceeds to the mode for checking whether the print switch is pressed (step S415).

In this preferred embodiment, when the automatic start prohibiting flag is ON, after detecting that the print switch is pressed or detecting the condition of the original document detection sensor 2, i.e., detecting that an original document is turned on, off and on again, resumption of the copying operations by the automatic original document feeder B is allowed.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

an automatic original document feeder;

original document detection means for detecting that an original document is set in the automatic original document feeder; and automatic start control means for automatically starting an image formation operation upon receipt of an original document detection signal from the original document detection means, means included in the automatic start control means for suspension of an automatic start operation upon detection of a signal which demands suspension of an automatic start operation, and means for prohibiting automatic feeding of original documents immediately after a cause of the suspension is eliminated.

2. The image forming apparatus of claim 1, wherein the signal which demands suspension of the automatic start operation is output in the case of an original document jam on the automatic original document feeder, and the automatic start control means has a function of prohibiting the automatic start operation even when the original document detection signal from the original document detection means is received after the original document jam is eliminated by removing the jammed original document.

3. The image forming apparatus of claim 2, further including a print switch provided in the main body of the apparatus so that upon pressing the print switch the automatic start control means has a function of instructing to start the image forming apparatus, even in the state where the function of prohibiting the automatic start operation is being executed when there is an original document detection signal from the original document detection means.

4. The image forming apparatus of claim 1, wherein the signal which demands suspension of the automatic start operation is a copying suspension instruction signal by an operator, and the automatic start control means has a function of prohibiting the automatic start operation even when the original document detection signal from the original document detection means is received after the copying suspension instruction signal is output.

5. The image forming apparatus of claim 4, further including a print switch provided in the main body of the apparatus so that upon pressing the print switch the automatic start control means has a function of instructing to start the image forming apparatus, even in the state where the function of prohibiting the automatic start operation is being executed when there is an original document detection signal from the original document detection means.

6. The image forming apparatus of claim 1, wherein the signal which demands suspension of the automatic start operation is output when the automatic original document feeder in an open state is closed, and when said signal is output, the automatic start control means has a function of prohibiting the automatic start operation even when the original document detection signal from the original document detection means is received.

7. The image forming apparatus of claim 6, further including a print switch provided in the main body of the apparatus so that upon pressing the print switch the automatic start control means has a function of instructing to start the image forming apparatus, even in the state where the function of prohibiting the automatic start operation is being executed when there is an original document detection signal from the original document detection means.

8. The image forming apparatus of claim 1, further including a print switch provided in the main body of the apparatus so that upon pressing the print switch the automatic start control means has a function of instructing to start the image forming apparatus, even in the state where the function of prohibiting the automatic start operation is being executed when there is an original document detection signal from the original document detection means.

* * * * *